US009346519B2

(12) United States Patent
Lee

(10) Patent No.: US 9,346,519 B2
(45) Date of Patent: May 24, 2016

(54) FLUID SHIELD ASSEMBLY

(71) Applicant: William R. Lee, Edgewater, FL (US)

(72) Inventor: William R. Lee, Edgewater, FL (US)

( * ) Notice: Subject to any disclaimer, the term of this patent is extended or adjusted under 35 U.S.C. 154(b) by 0 days.

(21) Appl. No.: 14/490,330

(22) Filed: Sep. 18, 2014

(65) Prior Publication Data

US 2016/0083047 A1 Mar. 24, 2016

(51) Int. Cl.
*B63B 17/02* (2006.01)
*B63B 17/00* (2006.01)

(52) U.S. Cl.
CPC ..... *B63B 17/00* (2013.01); *B63B 2221/00* (2013.01)

(58) Field of Classification Search
CPC ..... B63B 17/02; B63B 17/00
USPC ..... 114/361
See application file for complete search history.

(56) References Cited

U.S. PATENT DOCUMENTS

| | | | | |
|---|---|---|---|---|
| 932,909 | A * | 8/1909 | Saunders | E04H 15/18 135/117 |
| 5,092,262 | A | 3/1992 | Lacy | |
| 5,121,703 | A | 6/1992 | Smith | |
| 5,291,848 | A | 3/1994 | Wilhelm et al. | |
| 5,309,860 | A * | 5/1994 | Shearer | E05D 5/10 114/361 |
| 5,564,358 | A | 10/1996 | Newton | |
| 6,595,155 | B1 | 7/2003 | Akers | |
| 7,506,605 | B2 | 3/2009 | Duffield | |
| D637,134 | S | 5/2011 | Kaiser | |
| 8,001,919 | B2 | 8/2011 | Shearer et al. | |
| 8,397,659 | B1 * | 3/2013 | Nastrom | B63B 17/023 114/361 |

* cited by examiner

*Primary Examiner* — Stephen Avila

(57) ABSTRACT

A fluid shield assembly for preventing fluid from entering a bow of a boat includes a panel that has an outer edge extending between a front side and a back side of the panel. The panel has a pair of slots each extending downwardly from a top side of the outer edge of the panel. The slots are evenly spaced apart from a middle of the top side of the outer edge of the panel to define the door portion of the panel. Each of a plurality of first fasteners engages a boat such that the panel is retained on a bow of the boat. The panel inhibits a fluid from entering the bow of the boat. The door portion of the panel is positioned over a door in the boat to selectively cover and expose the door in the boat.

6 Claims, 4 Drawing Sheets

FLUID SHIELD ASSEMBLY

BACKGROUND OF THE DISCLOSURE

Field of the Disclosure

The disclosure relates to shield devices and more particularly pertains to a new shield device for preventing fluid from entering a bow of a boat.

SUMMARY OF THE DISCLOSURE

An embodiment of the disclosure meets the needs presented above by generally comprising a panel has an outer edge extending between a front side and a back side of the panel. The panel has a pair of slots each extending downwardly from a top side of the outer edge of the panel. The slots are evenly spaced apart from a middle of the top side of the outer edge of the panel to define the door portion of the panel. Each of a plurality of first fasteners engages a boat such that the panel is retained on a bow of the boat. The panel inhibits a fluid from entering the bow of the boat. The door portion of the panel is positioned over a door in the boat to selectively cover and expose the door in the boat.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
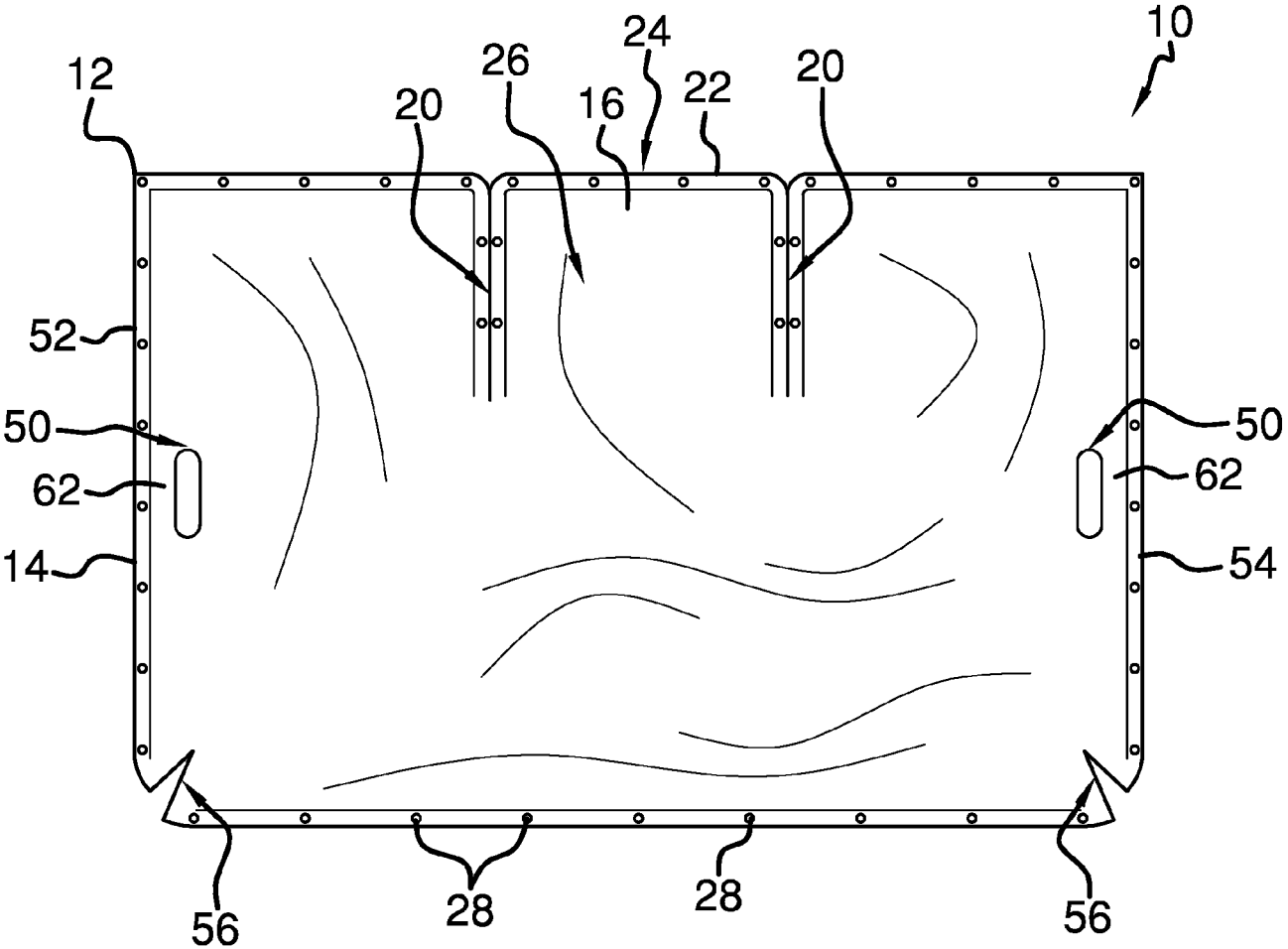
FIG. 1 is a top view of a fluid shield assembly according to an embodiment of the disclosure.
Figure 2:
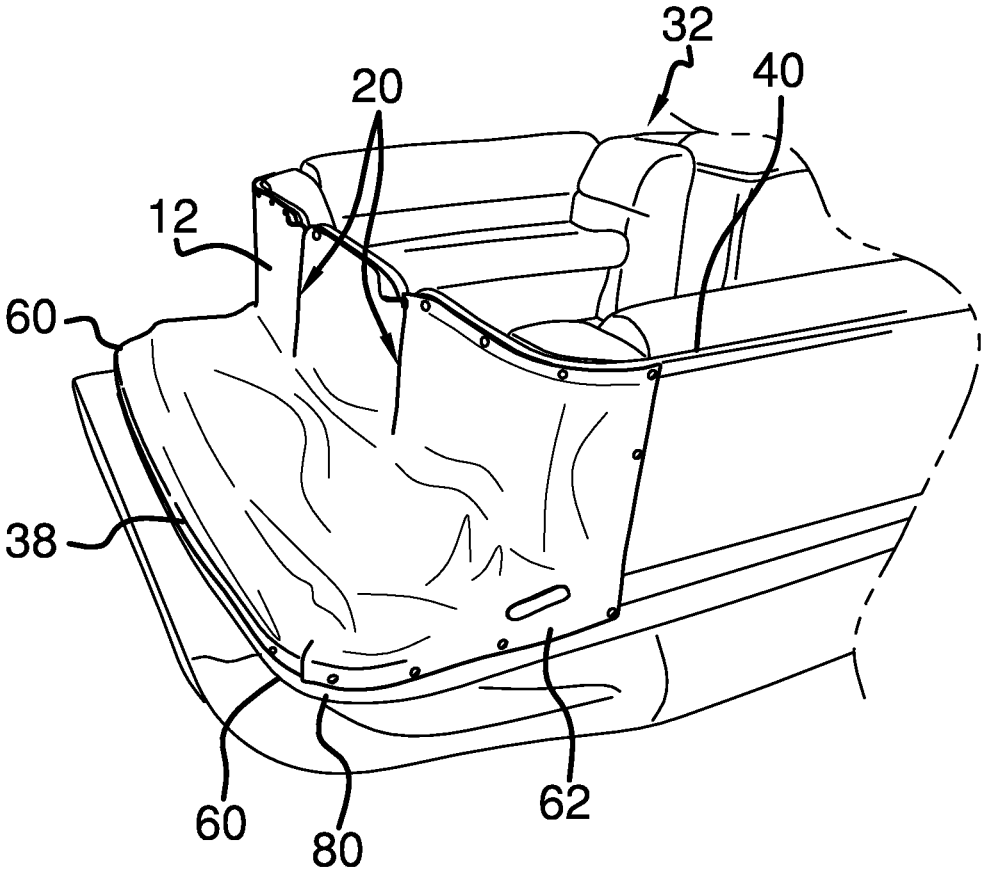
FIG. 2 is an in-use view of an embodiment of the disclosure.
Figure 3:
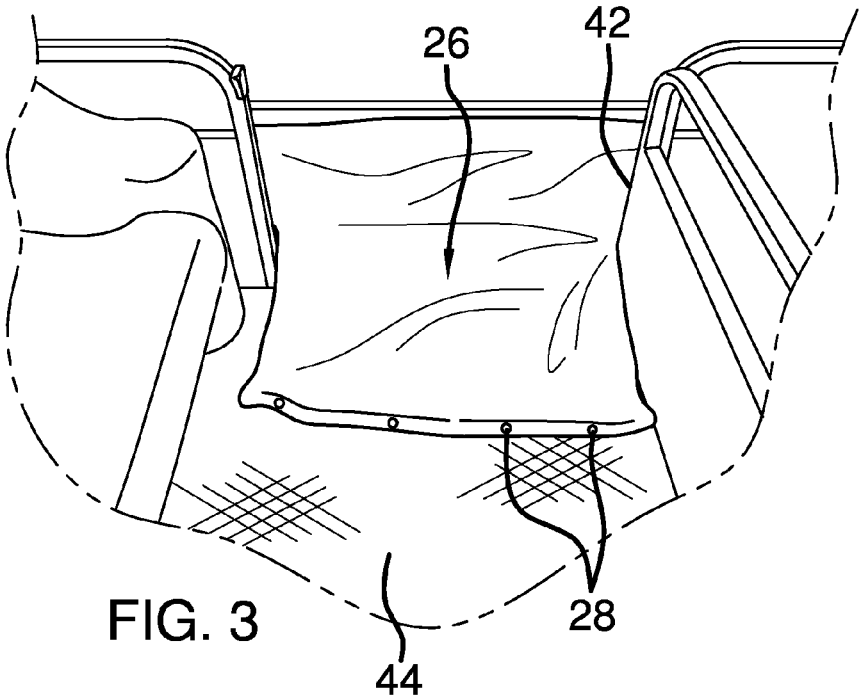
FIG. 3 is a back view of an embodiment of the disclosure.
Figure 4:
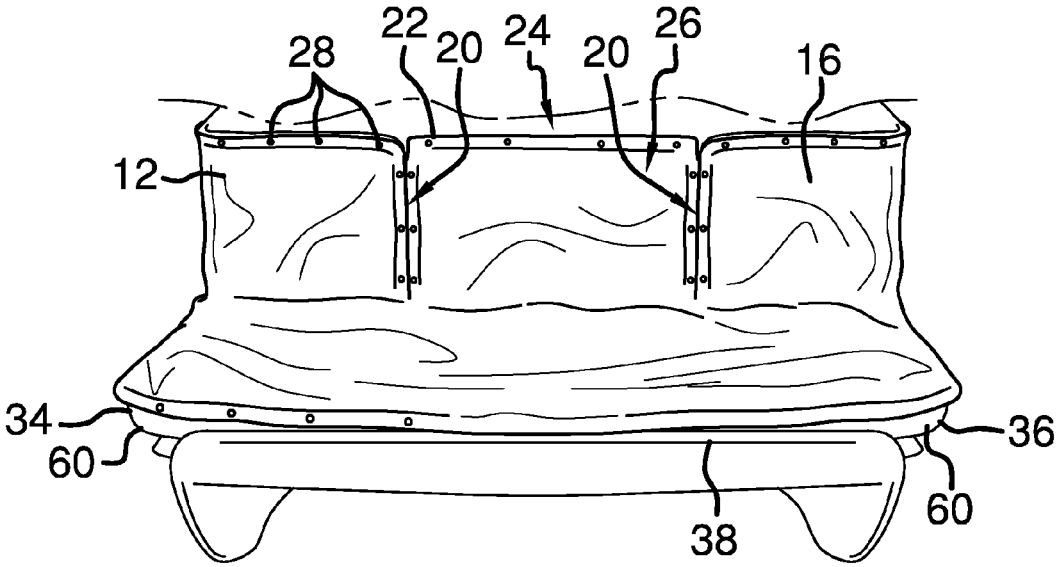
FIG. 4 is a front view of an embodiment of the disclosure.
Figure 5:
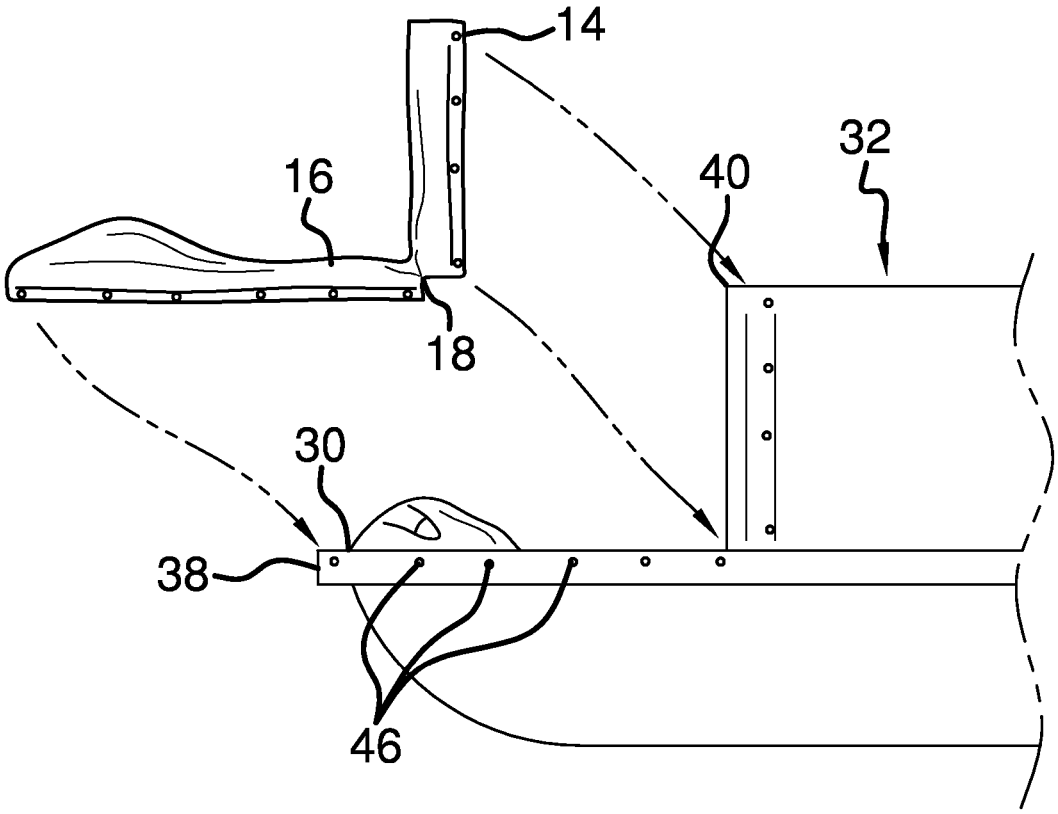
FIG. 5 is a left side view of an embodiment of the disclosure.

With reference now to the drawings, and in particular to FIGS. 1 through 5 thereof, a new shield device embodying the principles and concepts of an embodiment of the disclosure and generally designated by the reference numeral 10 will be described.

As best illustrated in FIGS. 1 through 5, the fluid shield assembly 10 generally comprises a panel 12. The panel 12 has an outer edge 14 extending between a front side 16 and a back side 18 of the panel 12. The panel 12 has a pair of slots 20 each extending downwardly from a top side 22 of the outer edge 14 of the panel 12. The slots 20 are evenly spaced apart from a middle 24 of the top side 22 of the outer edge 14 of the panel 12 to define a door portion 26. The panel 12 may be comprised of a flexible and fluid impermeable material.

A plurality of first fasteners 28 is coupled to the panel 12. Each of the first fasteners 28 extend through the front 16 and back 18 sides of the panel 12. The first fasteners 28 are evenly spaced apart and distributed around an entire perimeter of the panel 12. Additionally, the first fasteners 28 are distributed along opposite sides of each of the slots 20 in the panel 12. The first fasteners 28 may be snaps, buttons or the like.

The panel 12 is positionable on a bow 30 of a boat 32 so the panel 12 extends between a first lateral side 34 and a second lateral side 36 of the bow 30 of the boat 32. The panel 12 is further positionable on the bow 30 of the boat 32 so the panel 12 extends between a leading edge 38 of the bow 30 of the boat 32 and an upper edge 40 of the bow 30 of the boat 32. The door portion 26 of the panel 12 extends laterally across a door 42 on the bow 30 of the boat 32. The door portion 26 of the panel 12 may selectively cover and expose the door 42 in the boat 32. Additionally, the boat 32 may be a pontoon boat of any conventional design. The door portion 26 of the panel 12 is positionable on a floor 44 of the boat 32 when the door 42 on the bow 30 of the boat 32 is positioned in an open position. The bow 30 of the boat 32 is accessible when the door portion 26 of the panel 12 is positioned on the floor 44 of the boat 32.

A plurality of second fasteners 46 is coupled to the bow 30 of the boat 32. The second fasteners 46 are evenly spaced apart and distributed around an entire perimeter of the bow 30 of the boat 32 corresponding to positioning of the first fasteners 28. The first fasteners 28 are complementary to the second fasteners 46. Thus, the panel 12 is couplable to the boat 32 such that the panel 12 is relatively taut or conforming to a shape of the bow 30.

The first fasteners 28 each engage an associated one of the second fasteners 46. The panel 12 is removably retained on the bow 30 of the boat 32. The panel 12 inhibits a fluid 48 from entering the bow 30 of the boat 32.

The panel 12 has a pair of cutouts 50 extending through the front 16 and back 18 sides of the panel 12. Each of the cutouts 50 is positioned proximate an associated one of a first oblique side 52 and a second oblique side 54 of the outer edge 14 of the panel 12 to define a pair of handles 62. Each of the handles 62 may be gripped. Additionally, the panel 12 has a pair of slits 56 each extending inwardly from the outer edge 14 of the panel. Each of the slits 56 is positioned at an intersection of a bottom side 58 of the outer edge 14 of the panel 12 and an associated one of the first 52 and second 54 oblique sides of the outer edge 14 of the panel 12.

In use, the panel 12 is coupled to the bow 30 of the boat 32 when the boat 32 is be utilized. The slit 56 are each positioned at an associated one of a pair of front corners 60 of the bow 30 of the boat 32. The slits 56 allow the panel 12 to wrap around the front corners 60 of the bow 30 of the boat 32. The panel 12 prevents the fluid 48 from entering the bow 30 of the boat 32 when the boat 32 is driven through the fluid 48. The panel 12 may be left on the boat 32 for an indefinite amount of time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fluid shield assembly comprising:

a boat having a bow and a door;

a panel, said panel being flexible, said panel having an outer edge extending between a front side and a back side of said panel, said panel having a pair of slots each extending downwardly from a top side of said outer edge of said panel, said slots being evenly spaced apart from a middle of said top side of said outer edge of said panel to define said door portion of said panel; and a plurality of first fasteners coupled to said panel such that each of said first fasteners engages the boat such that said panel is retained on the bow of the boat wherein said panel is configured to prevent a fluid from entering the bow of the boat, said door portion of said panel being positioned over the door in the boat such that said door portion of said panel selectively covers and exposes the door in the boat.

2. The assembly according to claim 1, further comprising said plurality of first fasteners being coupled to said panel such that said first fasteners extend through said front and back sides of said panel, said first fasteners being evenly spaced apart and distributed around an entire perimeter of said panel.

3. The assembly according to claim 2, further comprising said panel being positionable on the bow of the boat such that said panel extends between a first lateral side and a second lateral side of the bow of the boat.

4. The assembly according to claim 3, wherein said panel being further positionable on the bow of the boat such that said panel extends between a leading edge of the bow of the boat and an upper edge of the bow of the boat wherein said door portion of said panel extends laterally across a door on the bow of the boat.

5. The assembly according to claim 4, further comprising said door portion of said panel being positionable on a floor of the boat when the door on the bow of the boat is positioned in an open position such that the bow of the boat is accessible.

6. A fluid shield assembly comprising:

a boat having a bow and a door;

a panel, said panel being flexible, said panel having an outer edge extending between a front side and a back side of said panel, said panel having a pair of slots each extending downwardly from a top side of said outer edge of said panel, said slots being evenly spaced apart from a middle of said top side of said outer edge of said panel to define a door portion of said panel;

a plurality of first fasteners coupled to said panel such that said first fasteners extend through said front and back sides of said panel, said first fasteners being evenly spaced apart and distributed around an entire perimeter of said panel;

said panel being positionable on the bow of the boat such that said panel extends between a first lateral side and a second lateral side of the bow of the boat, said panel being further positionable on the bow of the boat such that said panel extends between a leading edge of the bow of the boat and an upper edge of the bow of the boat wherein said door portion of said panel extends laterally across the door on the bow of the boat, said door portion of said panel being configured to selectively cover and expose the door in the boat;

said door portion of said panel being positionable on a floor of the boat when the door on the bow of the boat is positioned in an open position such that the bow of the boat is accessible; and said first fasteners each engaging the boat such that said panel is retained on the bow of the boat wherein said panel is configured to prevent a fluid from entering the bow of the boat.

* * * * *